US006019027A

United States Patent [19]

Furuya et al.

[11] Patent Number: 6,019,027

[45] Date of Patent: Feb. 1, 2000

[54] REFRIGERANT COMPRESSOR

[75] Inventors: Shunichi Furuya, Ogawa-machi; Hiroshi Kanai, Higashimatsuyama, both of Japan

[73] Assignee: Zexel Corporation, Tokyo, Japan

[21] Appl. No.: 09/081,509

[22] Filed: May 20, 1998

[30] Foreign Application Priority Data

May 30, 1997 [JP] Japan ..... 9-157381

[51] Int. Cl.[7] ..... F04B 1/16; F01B 3/02

[52] U.S. Cl. ..... 92/71; 92/153; 417/269

[58] Field of Search ..... 92/71, 153; 91/499; 417/269

[56] References Cited

U.S. PATENT DOCUMENTS

| | | | |
|---|---|---|---|
| 4,221,544 | 9/1980 | Ohta | 417/269 |
| 4,229,145 | 10/1980 | Isizuka | 417/269 |
| 4,260,337 | 4/1981 | Nomura | 417/269 |
| 4,301,716 | 11/1981 | Saegusa et al. | 92/71 |
| 4,321,019 | 3/1982 | Degawa et al. | 417/269 |
| 4,431,378 | 2/1984 | Hattori et al. | 417/269 |
| 4,641,570 | 2/1987 | Futamura et al. | 92/71 |
| 4,756,239 | 7/1988 | Hattori et al. | 92/71 |
| 4,767,283 | 8/1988 | Ikeda et al. | 417/269 |
| 4,781,539 | 11/1988 | Ikeda et al. | 417/269 |
| 5,044,892 | 9/1991 | Pettitt | 417/269 |
| 5,056,417 | 10/1991 | Kato et al. | 92/71 |
| 5,370,505 | 12/1994 | Takenaka et al. | 417/269 |
| 5,393,204 | 2/1995 | Kawahara | 417/269 |
| 5,483,867 | 1/1996 | Ikeda et al. | 92/71 |
| 5,779,004 | 7/1998 | Hoshino et al. | 92/71 X |

FOREIGN PATENT DOCUMENTS

| | | | |
|---|---|---|---|
| 1147848 | 4/1963 | Germany | 417/269 |
| 56-6083 | 1/1981 | Japan | 417/269 |
| 6-280746 | 10/1994 | Japan | 417/269 |

*Primary Examiner*—John E. Ryznic

*Attorney, Agent, or Firm*—Frishauf, Holtz, Goodman, Langer & Chick, P.C.

[57] ABSTRACT

A refrigerant compressor is provided. A cylinder block has a plurality of cylinder bores axially formed therethrough. A plurality of pistons are slidably received in the cylinder bores, respectively. A housing is secured to the cylinder block and has a crankcase defined therein. A drive shaft extends through the crankcase and has one end on a cylinder block side. A torque-transmitting member is received within the crankcase and mounted on the drive shaft, for rotation in unison with the drive shaft for converting torque transmitted from the drive shaft into reciprocating motion of each of the pistons. A bearing supports the one end of the drive shaft. The cylinder block has a bearing-receiving chamber having the bearing received therein, a lubricant-collecting groove formed at a rim of a crankcase-side opening of each of at least one of the cylinder bores in a manner such that the lubricant-collecting groove is open to the crankcase, for collecting lubricant therein, and a lubricant supply passage connecting between the lubricant-collecting groove and the bearing-receiving chamber to thereby supply the lubricant collected in the lubricant-collecting groove to the crankcase. The lubricant collected at a bottom of the crankcase is drawn up by rotation of the torque-transmitting member and splashed within the crankcase.

5 Claims, 4 Drawing Sheets

REFRIGERANT COMPRESSOR

BACKGROUND OF THE INVENTION

1. Field of the Invention

This invention relates to a refrigerant compressor, and more particularly to a refrigerant compressor for use in an air conditioning system for an automotive vehicle.

2. Description of the Prior Art

Conventionally, a refrigerant compressor, such as a swash plate compressor, includes a cylinder block formed therethrough with a plurality of cylinder bores, a housing secured to the cylinder block, a swash plate which is tiltably mounted on a drive shaft, for rotation in unison with the drive shaft, a plurality of pistons each reciprocating within a corresponding one of the cylinder bores as the swash plate rotates, and a crankcase defined in the housing. The swash plate is received in the crankcase.

When the compressor is in operation, lubricant collected at a bottom of the crankcase is drawn up and splashed within the crankcase by rotating members including the swash plate as they rotate to be supplied to sliding portions of bearings, the pistons, and other components within the crankcase (so-called splash lubrication method).

Another lubricating method of supplying lubricant is a forced-feed lubrication method in which lubricant is forcedly fed to a particular sliding portion by the use of a pump, such as a trochoid pump driven by torque transmitted from a drive shaft of a compressor.

However, when the splash lubrication method is employed, a sufficient amount of lubricant cannot be supplied to unexposed sliding members within the crankcase, such as bearings supporting a rear end of the drive shaft.

On the other hand, the forced-feed lubrication method makes it possible to supply a sufficient amount of lubricant even to the unexposed sliding portions within the crankcase. However, this method necessitates provision of a pump, which results in increased manufacturing costs of the compressor. Moreover, it is necessary to secure space for installation of the pump, which inevitably increases the size and weight of the compressor.

SUMMARY OF THE INVENTION

It is an object of the invention to provide a refrigerant compressor having a construction which enables sufficient supply of lubricant to a bearing supporting the rear end of a drive shaft of the compressor, without using any pump such as a trochoid pump.

To attain the above object, the present invention provides a refrigerant compressor comprising:

a cylinder block having a plurality of cylinder bores axially formed therethrough;

a plurality of pistons slidably received in the cylinder bores, respectively;

a housing secured to the cylinder block and having a crankcase defined therein;

a drive shaft extending through the crankcase and having one end on a cylinder block side;

a torque-transmitting member received within the crankcase and mounted on the drive shaft, for rotation in unison with the drive shaft for converting torque transmitted from the drive shaft into reciprocating motion of each of the pistons; and a bearing supporting the one end of the drive shaft;

the cylinder block having:

a bearing-receiving chamber having the bearing received therein, a lubricant-collecting groove formed at a rim of a crankcase-side opening of each of at least one of the cylinder bores in a manner such that the lubricant-collecting groove is open to the crankcase, for collecting lubricant therein, and a lubricant supply passage connecting between the lubricant-collecting groove and the bearing-receiving chamber to thereby supply the lubricant collected in the lubricant-collecting groove to the crankcase, the lubricant collected at a bottom of the crankcase being drawn up and splashed within the crankcase by rotation of the torque-transmitting member.

According to the refrigerant compressor, lubricant attached to each piston during the suction stroke of the piston is scrubbed off by the rim of opening of the cylinder bore during the compression stroke of the piston, and collects in the lubricant-collecting groove. Then, the collected lubricant is supplied to the bearing-receiving chamber via the lubricant supply passage for lubrication of the bearing within the bearing-receiving chamber. Therefore, it is possible to supply a sufficient amount of lubricant to the bearing supporting the rear end of the drive shaft, without using any pump such as a trochoid pump, so that the compressor is not required to have a complicated construction. This contributes to reduction of the manufacturing costs of the compressor. Further, it is not necessary to secure space for incorporation of a pump. This makes it possible to reduce the size and weight of the compressor, as well.

Preferably, the lubricant-collecting groove has a cross-sectional area that gradually decreases from the crankcase-side opening thereof toward an inner wall where the lubricant supply passage opens.

According to this preferred embodiment, since the cross-sectional area of the lubricant-collecting groove gradually decreases toward a lubricant inlet port of the lubricant supply passage, lubricant readily collects at the lubricant inlet port of the lubricant supply passage, and pressure of the lubricant in the lubricant-collecting groove is further increased. Therefore, the lubricant in the lubricant-collecting groove can be efficiently fed into the lubricant supply passage, which ensures reliable and sufficient lubrication and cooling of the bearing.

More preferably, the lubricant-collecting groove has a sloping bottom surface that slopes down toward the crankcase-side opening.

Preferably, the at least one of the cylinder bores that is formed with the lubricant-collecting groove is located at an uppermost position, in a direction of gravitation in a state in which the compressor is installed, of all the cylinder bores.

According to this preferred embodiment, even when the rotational speed of the drive shaft is low, and hence the pressure of the lubricant in the lubricant-collecting groove is not high, the gravitational force causes the lubricant to flow through the lubricant supply passage into the bearing-receiving chamber, which makes it possible to lubricate the bearing within the bearing-receiving chamber in a further reliable manner.

The above and other objects, features and advantages of the present invention will become more apparent from the following detailed description taken in conjunction with accompanying drawings.

DETAILED DESCRIPTION OF THE PREFERRED EMBODIMENTS

The invention will now be described in detail with reference to drawings showing preferred embodiments thereof.

Figure 1:
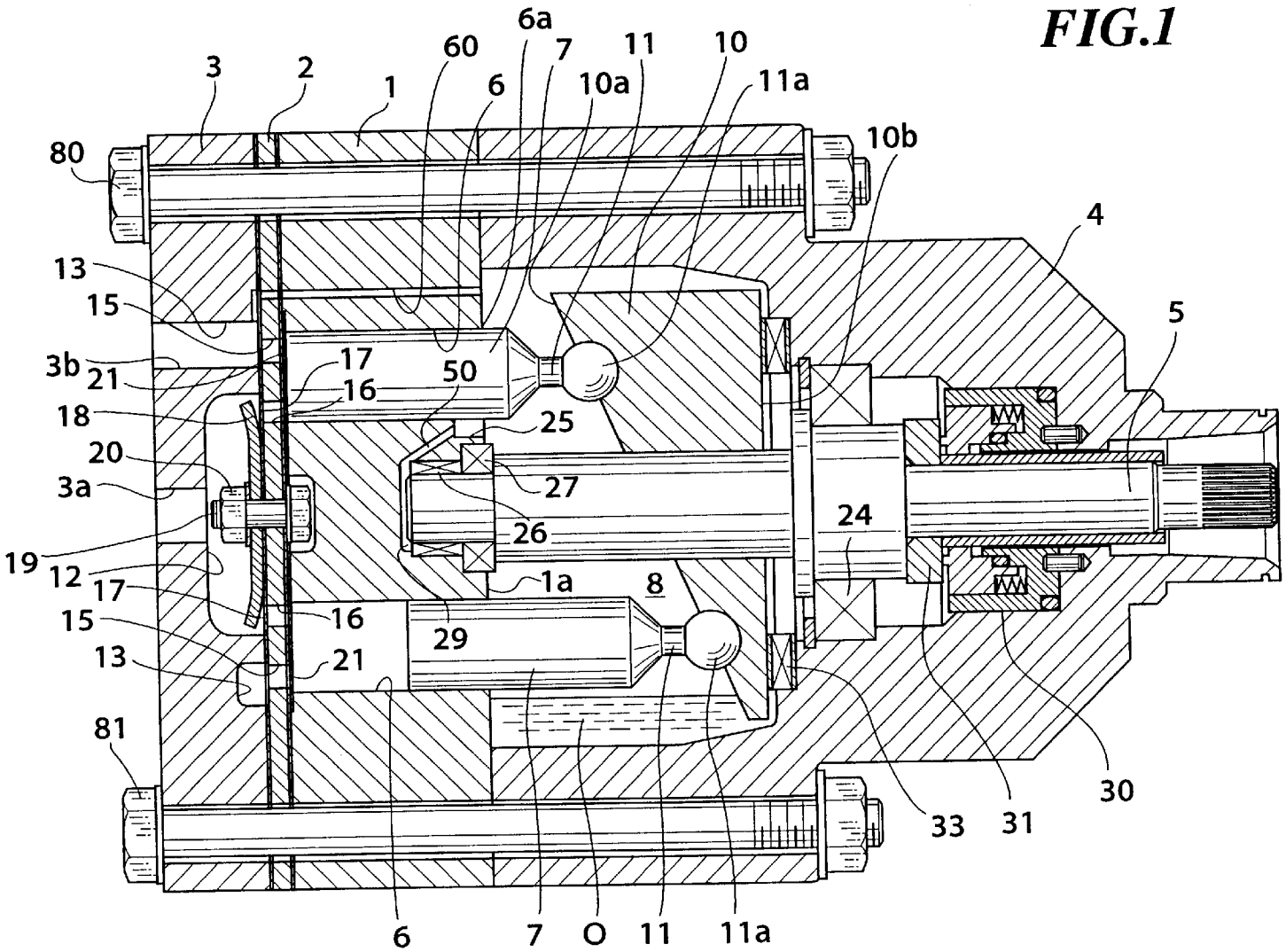
FIG. 1 is a longitudinal cross-sectional view showing the whole arrangement of a swash plate compressor according to a first embodiment of the invention.
Figure 2:
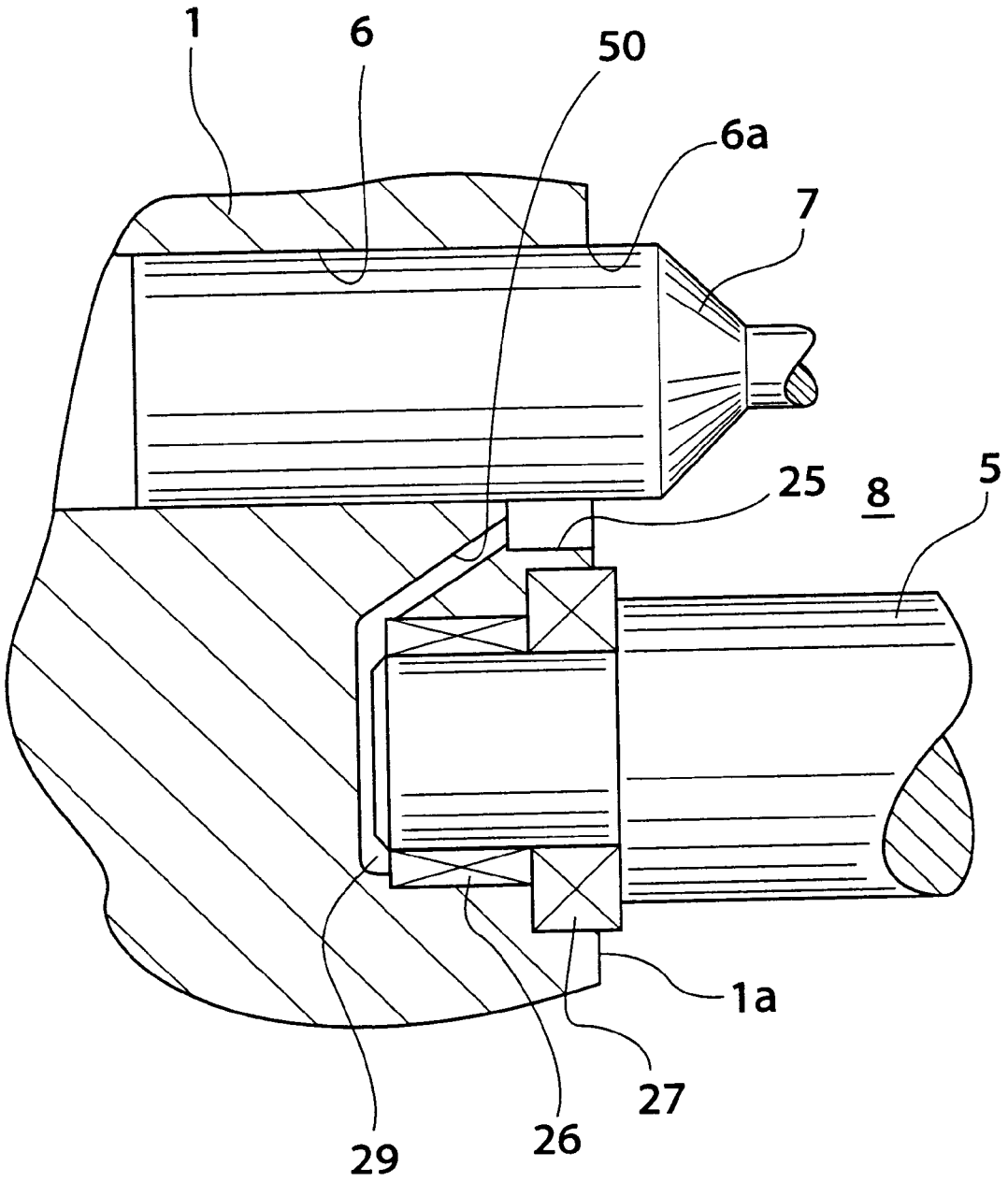
FIG. 2 is an enlarged sectional view showing essential parts of the FIG. 1 swash plate compressor.

FIG. 1 shows the whole arrangement of a swash plate compressor according to a first embodiment of the invention, and FIG. 2 shows essential parts of the compressor on an enlarged scale. In the figures, the internal construction of the compressor is schematically shown, and hence component parts such as a swash plate are not illustrated in detail.

The swash plate compressor has a cylinder block 1 having one end thereof secured to a rear head 3 via a valve plate 2 and the other end thereof secured to a front head 4. The cylinder block 1, the rear head 3, and the front head 4 are tightened in a longitudinal direction by through bolts 80, 81.

The cylinder block 1 has a plurality of cylinder bores 6 axially formed therethrough at predetermined circumferential intervals about a drive shaft 5. Each cylinder bore 6 has a piston 7 slidably received therein. It is preferred that there is a clearance of several $\mu$m to approximately 20 $\mu$m between an inner peripheral wall of the cylinder bore 6 and the piston 7.

A cylinder bores 6 that is located at an uppermost position of all the cylinder bores 6 (i.e. an uppermost position in the direction of gravitation in a state in which the compressor is installed e.g. on an automotive vehicle) within the cylinder block 1 has a rim 6*a* of opening thereof formed with a lubricant-collecting groove 25. The lubricant-collecting groove 25 is open to a crankcase 8 defined in the front head 4.

A front end face 1*a* of the cylinder block 1 has a central portion formed with a bearing-receiving chamber 29. The bearing-receiving chamber 29 has a radial bearing 26 and a thrust bearing 27 received therein. The two bearings 26 and 27 rotatable support a rear end of the drive shaft 5. The bearing-receiving chamber 29 communicates with the lubricant-collecting groove 25 via a lubricant supply passage 50 formed through the cylinder block 1.

The crankcase 8 has a swash plate (torque-transmitting member) 10 received therein. The swash plate 10 is rigidly fitted on the drive shaft 5. Lubricant O is collected at the bottom of the crankcase 8.

The swash plate 10 has an inclined surface 10*a* which is inclined at a predetermined angle with respect to an imaginary plane orthogonal to the drive shaft 5. The length of stroke of each piston 7 is determined according to the predetermined inclination angle of the inclined surface 10*a* of the swash plate 10. Further, the swash plate 10 has a vertical surface 10*b* orthogonal to the drive shaft 5. The vertical surface 10*b* of the swash plate 10 is rotatably supported on an inner wall surface of the front head 4 by a thrust bearing 33. Each connecting rod 11 has one end thereof secured to a corresponding one of the pistons 7 and the other end 11*a*, spherical in shape, connected to the inclined surface 10*a* of the swash plate 10 such that it slidable on the inclined surface 10*a* of the swash plate 10.

The drive shaft 5 has an intermediate portion thereof rotatably supported by a radial bearing 24 arranged within the front head 4. A shaft seal is interposed between an inner peripheral wall of the front head 4 and a front end of the drive shaft 5. The shaft seal is comprised of a rotatable mechanical seal 31 and a stationary mechanical seal 30.

The rear head 3 defines a discharge chamber 12 and a suction chamber 13 surrounding the discharge chamber 12.

The valve plate 2 is formed with refrigerant outlet ports 16 for each communicating between a compression chamber within a corresponding one of the cylinder bores 6 and the discharge chamber 12, and refrigerant inlet ports 15 for each communicating between a compression chamber within a corresponding one of the cylinder bores 6 and the suction chamber 13. The refrigerant outlet ports 16 and the refrigerant inlet ports 15 are arranged at predetermined circumferential intervals, about the drive shaft 5. The refrigerant outlet ports 16 are opened and closed by respective discharge valves 17 formed as a unitary member. The unitary member of the discharge valves 17 is fixed to a rear head-side end face of the valve plate 2 by a bolt 19 and a nut 20 together with a valve stopper 18.

On the other hand, the refrigerant inlet ports 15 are opened and closed by respective suction valves 21 formed as a unitary member arranged between the valve plate 2 and the cylinder block 1. A communication passage 60 is formed through the cylinder block 1 to connect between the suction chamber 13 and the crankcase 8.

Next, the operation of the compressor constructed as above will be described.

Torque of an engine, not shown, installed on an automotive vehicle, not shown, is transmitted to the drive shaft 5 to rotate the same. As the drive shaft 5 rotates, the swash plate 10 rotates in unison with the drive shaft 5.

The rotation of the swash plate 10 causes the spherical end 11*a* of each of the connecting rods 11 to slide on the inclined surface 10*a* of the swash plate 10, whereby the torque transmitted from the swash plate 10 is converted into the reciprocating motion of the piston 7. As the piston 7 reciprocates within the cylinder bore 6, the volume of the compression chamber within the cylinder bore 6 changes. As a result, suction, compression and delivery of refrigerant gas are sequentially carried out in the compression chamber. During the suction stroke of the piston 7, the corresponding suction valve 21 opens to draw low-pressure refrigerant gas from the suction chamber 13 into the compression chamber within the cylinder bore 6, while during the compression stroke of the piston 7, the corresponding discharge valve 17 opens to deliver high-pressure refrigerant gas from the compression chamber to the discharge chamber 12.

Figure 3A:
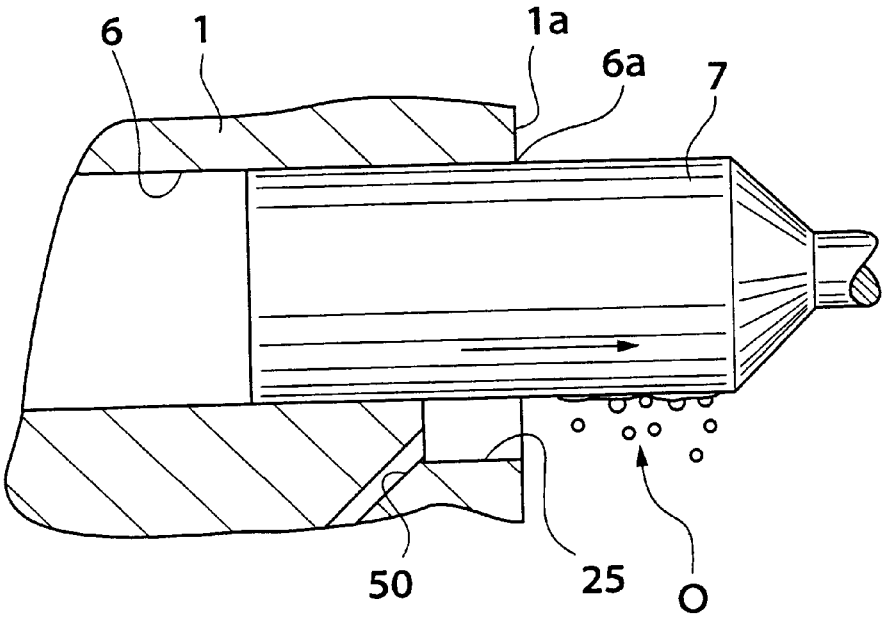
FIG. 3A is an enlarged sectional view showing part of a piston during the suction stroke thereof.
Figure 3B:
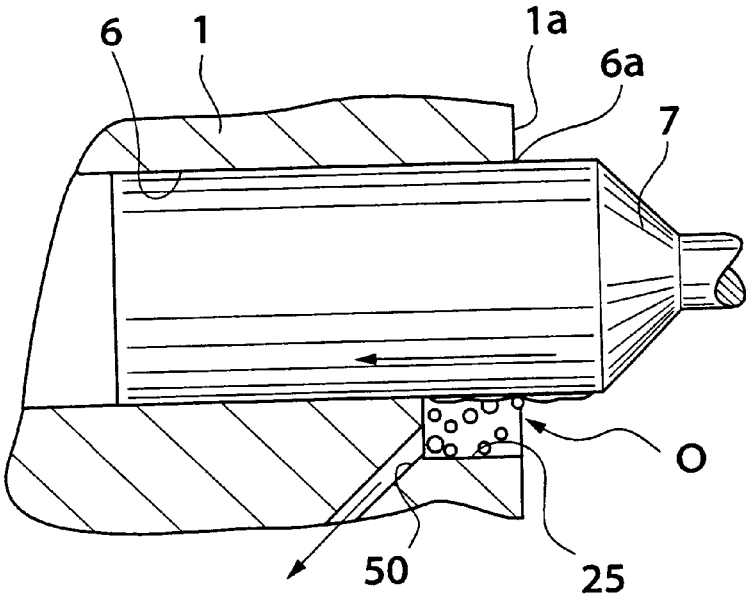
FIG. 3B is an enlarged sectional view showing part of the piston during the compression stroke thereof.

FIG. 3A shows part of the piston during the suction stroke thereof, on an enlarged scale, while FIG. 3B shows part of the piston during the compression stroke thereof, on an enlarged scale.

During operation of the compressor, the lubricant O collected at the bottom of the crankcase 8 is drawn up and splashed within the crankcase 8 by rotation of the swash plate 10.

As shown in FIG. 3A, during each suction stroke, the piston 7 projects from the front end face la of the cylinder bore 6 into the crankcase 8, and the lubricant O drawn up and splashed within the crankcase 8 by the swash plate 10 is attached to the peripheral surface of the piston 7. At the end of the suction stroke, the exposed area of the peripheral surface of the piston 7 becomes maximum, and hence the amount of the lubricant attached thereto also becomes maximum.

On the other hand, as shown in FIG. 3B, during each compression stroke, when the piston 7 moves from its bottom dead center position to its top dead center position, the lubricant attached to the peripheral surface of the piston 7 is scrubbed off by the rim 6*a* of opening of the cylinder bore 6.

The lubricant O scrubbed off the piston 7 collects in the lubricant-collecting groove 25 to be supplied to the bearing-receiving chamber 29 via the lubricant supply passage 50. The lubricant O supplied to the bearing-receiving chamber 29 flows through the radial bearing 26 and the thrust bearing 27, followed by returning to the crankcase 8. This lubricates and cools the two bearings 26 and 27.

As the rotational speed of the drive shaft 5 increases, the piston 7 reciprocates at a faster rate to thereby increase pressure of the lubricant O collected in the lubricant-collecting groove 25. As a result, the lubricant O is supplied to the radial bearing 26 and so forth at an increased flow rate, whereby lubrication of the bearings is promoted.

According to the swash plate compressor of the first embodiment, it is possible to supply a sufficient amount of lubricant O to the radial bearing 26 and the thrust bearing 27, which support the rear end of the drive shaft 5, without using a trochoid pump or the like, so that the compressor is not required to have a complicated construction, which contributes to reduction of the manufacturing costs of the compressor. Further, it is not necessary to secure space for incorporation of a pump, so that it is possible to reduce the size and weight of the compressor.

Moreover, since the lubricant-collecting groove 25 is formed in the cylinder bore 6 located at an uppermost position in the direction of gravitation of all the cylinder bores 6 (see FIG. 1) in a state in which the compressor is installed e.g. on an automotive vehicle, the gravitational force causes the lubricant O to flow through the lubricant supply passage 50 into the bearing-receiving chamber 29, even when the rotational speed of the drive shaft 5 is low and hence the pressure of the lubricant O collected in the lubricant-collecting groove 25 is not high. This ensures reliable lubrication of the radial bearing 26 and so forth.

Figure 4:
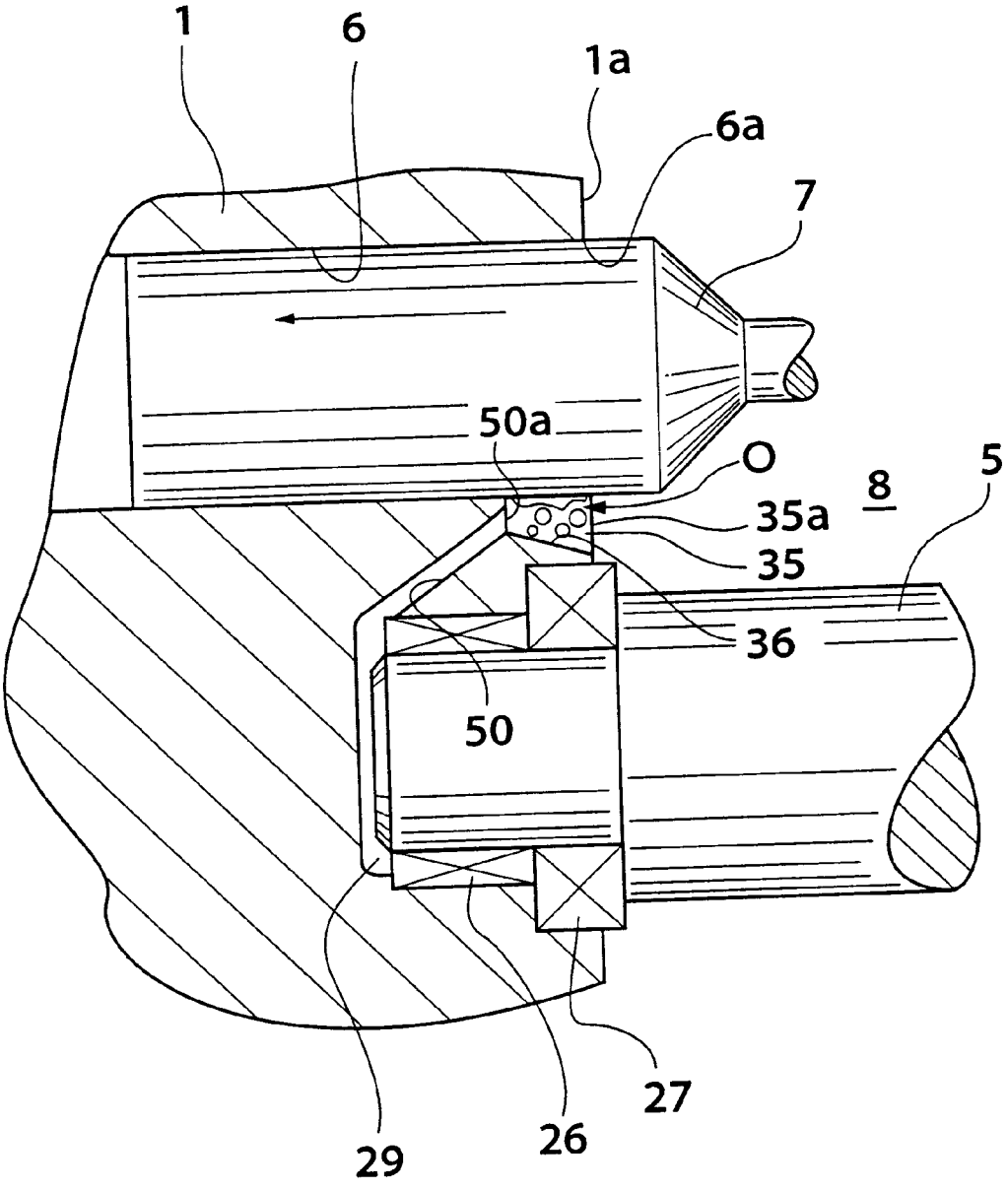
FIG. 4 is an enlarged view showing essential parts of a swash plate compressor according to a second embodiment of the invention.

FIG. 4 shows essential parts of a swash plate compressor according to a second embodiment, on an enlarged scale. Component parts and elements having the same construction and functions as those described of the first embodiment are designated by identical reference numerals, and detailed description thereof is omitted.

In the second embodiment, a lubricant-collecting groove 35 has a cross-sectional area thereof gradually decreased toward a lubricant inlet port 50*a* of the lubricant supply passage 50. More specifically, the lubricant-collecting groove 35 has an inner wall formed with a sloping bottom surface 36 for guiding lubricant scrubbed off the piston 7 to the lubricant inlet port 50*a* of the lubricant supply passage 50. The sloping bottom surface 36 slopes down from the lubricant inlet port 50*a* toward an open end 35*a* of the lubricant-collecting groove 35.

The swash plate compressor according to the second embodiment provides the same effects as obtained by the compressor according to the first embodiment. Further, since the cross-sectional area of the lubricant-collecting groove 35 is gradually decreased toward the lubricant inlet port 50*a* of the lubricant supply passage 50, and the lubricant O collected in the lubricant-collecting groove 35 is guided along the sloping bottom surface 36 to the lubricant inlet port 50*a* of the lubricant supply passage 50, the lubricant O is easy to collect at the lubricant inlet port 50*a*, and the pressure of the lubricant O thereat is further increased. As a result, the lubricant O can be efficiently supplied into the lubricant supply passage 50, which ensures more reliable and sufficient lubrication and cooling of the bearings 26, 27.

Although in the above embodiments, the lubricant-collecting groove 25(35) is formed in one portion of the rim 6*a* of opening of the cylinder bore 6, this is not limitative, but a variation is possible in which an annular lubricant-collecting groove 25(35) is formed along the whole rim 6*a* of opening of the cylinder bore 6.

Further, although in the above embodiment, description is made of a case in which the invention is applied to a fixed capacity swash plate compressor, this is not limitative, but the invention may be applied to a variable capacity swash plate compressor and other types of refrigerant compressors such as a wobble plate compressor.

It is further understood by those skilled in the art that the foregoing is the preferred embodiments of the invention, and that various changes and modification may be made without departing from the spirit and scope thereof.

What is claimed is:

1. A refrigerant compressor comprising:

a cylinder block having a plurality of cylinder bores axially formed therethrough;

a plurality of pistons slidably received in said cylinder bores, respectively;

a housing secured to said cylinder block and having a crankcase defined therein;

a drive shaft extending through said crankcase and having one end on a cylinder block side;

a torque-transmitting member received within said crankcase and mounted on said drive shaft, for rotation in unison with said drive shaft for converting torque transmitted from said drive shaft into reciprocating motion of each of said pistons; and a bearing supporting said one end of said drive shaft;

said cylinder block having:

a bearing-receiving chamber having said bearing received therein, a lubricant-collecting groove formed at a rim of a crankcase-side opening of each of at least one of said cylinder bores in a manner such that said lubricant-collecting groove is open to said crankcase, for collecting lubricant therein, and a lubricant supply passage connecting between said lubricant-collecting groove and said bearing-receiving chamber to thereby supply said lubricant collected in said lubricant-collecting groove to said crankcase, said lubricant collected at a bottom of said crankcase being drawn up and splashed within said crankcase by rotation of said torque-transmitting member.

2. A refrigerant compressor according to claim 1, wherein said lubricant-collecting groove has a cross-sectional area that gradually decreases from said crankcase-side opening thereof toward an inner wall where said lubricant supply passage opens.

3. A refrigerant compressor according to claim 2, wherein said lubricant-collecting groove has a sloping bottom surface that slopes down toward said crankcase-side opening.

4. A refrigerant compressor according to claim 1, wherein said at least one of said cylinder bores that is formed with said lubricant-collecting groove is located at an uppermost position, in a direction of gravitation in a state in which said compressor is installed, of all said cylinder bores.

5. A refrigerant compressor according to claim 2, wherein said at least one of said cylinder bores that is formed with said lubricant-collecting groove is located at an uppermost position, in a direction of gravitation in a state in which said compressor is installed, of all said cylinder bores.

* * * * *